US006035174A

United States Patent [19]

Ito et al.

[11] Patent Number: 6,035,174

[45] Date of Patent: Mar. 7, 2000

[54] APPARATUS FOR CONTROLLING THE ROTATIONAL MOTION OF A FIXING APPARATUS

[75] Inventors: Tetsuro Ito, Anjo; Yuusuke Morigami, Toyohashi; Taizou Oonishi; Eiji Okabayashi, both of Toyokawa, all of Japan

[73] Assignee: Minolta Co., Ltd., Osaka, Japan

[21] Appl. No.: 09/210,737

[22] Filed: Dec. 15, 1998

[30] Foreign Application Priority Data

Dec. 16, 1997 [JP] Japan ..... 9-346006

[51] Int. Cl.[7] ..... G03G 15/20

[52] U.S. Cl. ..... 399/328; 219/216; 399/330; 399/331

[58] Field of Search ..... 399/328, 320, 399/330, 331, 332, 333, 334, 329; 219/216, 469, 601, 619, 635, 672

[56] References Cited

U.S. PATENT DOCUMENTS

| | | | |
|---|---|---|---|
| 5,713,069 | 1/1998 | Kato | 399/330 |
| 5,839,043 | 11/1998 | Okabayashi et al. | 399/329 |
| 5,852,763 | 12/1998 | Okuda et al. | 399/329 |
| 5,870,660 | 2/1999 | Ito et al. | 399/330 |

FOREIGN PATENT DOCUMENTS

| | | |
|---|---|---|
| 06019345 | 1/1994 | Japan . |
| 06075493 | 3/1994 | Japan . |

*Primary Examiner*—William Royer
*Assistant Examiner*—Hoan Tran
*Attorney, Agent, or Firm*—McDermott, Will & Emery

[57] ABSTRACT

In a fixing apparatus having a flexible metal fixing sleeve provided around a holder, which holds a coil inside, and heated by induction current of the coil, and a pressure roller that pinches the fixing sleeve between it and the holder by pressing on the holder, the following relation is satisfied:

$$(F1+F2)/F3 \geqq 1.7$$

where symbols F1, F2 and F3 represent respectively during recording paper feeding: a drive force transmitted from the pressure roller to the fixing sleeve via recording paper in the region where the recording paper passes through; a drive force transmitted from the pressure roller directly to the fixing sleeve in the region where the recording paper does not pass through; and a friction resistance force generated between the inner surface of the fixing sleeve and the outer surface of the holder.

16 Claims, 12 Drawing Sheets

RECORDING PAPER NON-PASSAGE REGION

RECORDING PAPER PASSING REGION

RECORDING PAPER NON-PASSAGE REGION

RECORDING PAPER PASSING REGION

RECORDING PAPER NON-PASSAGE REGION

RECORDING PAPER PASSING REGION

APPARATUS FOR CONTROLLING THE ROTATIONAL MOTION OF A FIXING APPARATUS

This application is based on application No. 09-346006 filed in Japan, the contents of which is hereby incorporated by reference.

BACKGROUND OF THE INVENTION

1. Field of the Invention

The invention relates to a fixing apparatus applicable to electrophotographic image forming apparatuses, such as copiers, printers and facsimile machines, and machines that combine their functions.

2. Description of the Related Art

Various fixing apparatuses have been known in the prior art as one exemplified by the disclosure of JP-A-6-19345, comprising: a thin heat resistant film; and a heating device that is located and held fixedly on one side of the film while grasping the film; and a pressure roller that is located on the other side of the film opposing the heating device and pressing via the film against the heating device an image carrying side of recording paper where images are to be fixed. In said apparatus, the pressure roller rotates to feed the film and the recording paper at the same speed and fixation is done through heating.

Another type of fixing apparatus proposed by JP-A-6-75493 is equipped with: a heat roller containing a heater internally; a thin sleeve that is located on the outside of the heat roller and has an larger inner diameter than the outer diameter of the heat roller; and a pressure roller that is located to contact under pressure with the heat roller via the thin sleeve.

In these fixing apparatuses, the recording paper, on which the unfixed toner image is transferred to, passes through a nip area formed between the thin heat resistant film or the thin sleeve and the pressure roller, and the toner is fixed on the recording paper by means of pressure and heat applied during the passage. This means that the nip width can be widened and a lower heat capacity can be used. Consequently, it is possible to make the fixing apparatus smaller and reduce the power consumption.

However, in the fixing apparatus disclosed by JP-A-6-19345, the film is rotated by the drive force of the pressure roller while the film's inner face is contacting the heating device, so that there is a possibility that the driving force of the pressure roller is not effectively transmitted to the film when the recording paper is being fed, thus affecting the uniform rotation of the film.

As a means of solving this problem, several ideas have been proposed such as: providing a gear-like elastic protrusion on the end of the pressure roller; and increasing the friction coefficient of a portion of the film surface. However, even with these means, there is a possibility of irregular film rotation if the drive force is not properly transmitted from the pressure roller to the film.

Moreover, in the fixing apparatus disclosed by JP-A-6-75493, it is necessary to transmit the drive force of the heat roller-to the pressure roller through the rotation of the thin sleeve in order to rotate the pressure roller. Therefore, the drive force transmitted from the heat roller to the pressure roller through the thin sleeve is not appropriate, slippage may occur on the pressure roller thus deteriorating the rotation.

SUMMARY OF THE INVENTION

An object of the invention is to improve the fixing quality.

A further object of the invention is to provide a fixing apparatus that does not affect the rotation of a thin rotator such as a film when it is rotated by a drive force transmitted from a roller.

One aspect of the invention is a fixing apparatus comprising a rotator having a releasing agent layer on a surface thereof, a holder that supports the rotator from an inside thereof, a heating device to heat the rotator, and a drive roller with which the rotator is in contact under pressure to be driven thereby, the apparatus satisfying the following relation:

$$(F1+F2)/F3 \geqq 1.7$$

where symbols F1, F2 and F3 represent respectively during feeding a recording paper: a drive force transmitted from the drive roller to the rotator via the recording paper in a passing region where the recording paper passes through; a drive force transmitted directly from the drive roller to the rotator in a non-passage region where the recording paper does not pass through; and a load that occurs in a contact area between an inner surface of the rotator and an outer surface of the holder.

Another aspect of the invention is a fixing apparatus comprising: a rotator having a releasing agent layer on a surface thereof, a holder that supports the rotator from an inside thereof and rotates to cause the rotator to rotate, a heating device to heat the rotator, and a driven roller which is in contact with the rotator under pressure to be driven thereby, the fixing apparatus satisfying the following relation:

$$F1/F4 \geqq 1.7$$

and $$F2+F3 \geqq F4$$

where symbols F1, F2, F3 and F4 represent respectively during feeding a recording paper: a drive force transmitted from the holder to an internal surface of the rotator; a drive force transmitted from the surface of the rotator to the driven roller via the recording paper in a passing region where the recording paper passes through; a drive force transmitted from the surface of the rotator directly to the driven roller in a non-passage region where the recording paper does not pass through; and a rotation resistance force generated when the driven roller is driven by the rotator.

Another aspect of the invention is a fixing apparatus comprising a rotator having a releasing agent layer on a surface thereof, supports that are maintained rotatably inside the rotator and sustain both ends of the rotator, a heating device to heat the rotator, and a drive roller that drives the rotator by nipping it between itself and the supports, the apparatus satisfying the following relation:

$$(F1+F2)/F3 \geqq 1.7$$

and $$F3<F4$$

where symbols F1, F2, F3 and F4 represent respectively during feeding a recording paper: a drive force transmitted from the drive roller to the rotator via the recording paper in a passing region where the recording paper passes through; a drive force transmitted directly from the drive roller to the rotator in a non-passage region where the recording paper does not pass through; a rotation resistance force of the supports; and a friction resistance force generated between an inner surface of the rotator and an outer surface of the supports.

The objects, characteristics, and advantages of this invention other than those set forth above will become apparent from the following detailed description of the preferred embodiments, which makes reference to the annexed drawings.

DETAILED DESCRIPTION OF THE INVENTION

The embodiments of this invention will be described below with reference to the accompanying drawings.

Embodiment 1

Figure 1:
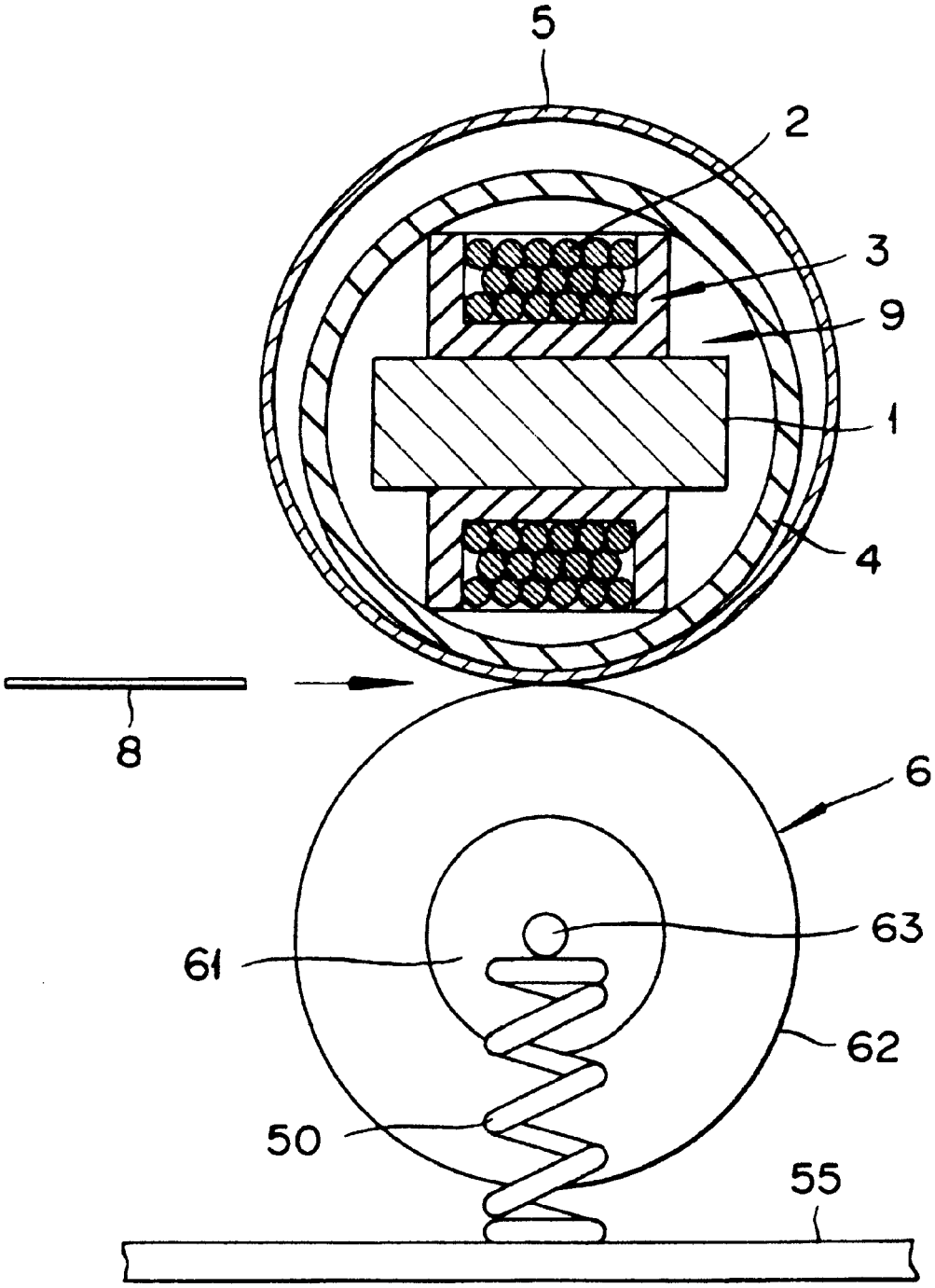
FIG. 1 is a side view of a fixing apparatus of a first embodiment according to the present invention.

An induction heating type fixing apparatus shown in FIG. 1 comprises: a coil assembly 9 consisting of a core 1 and a coil 2 wound around the core 1; a holder 4 that internally contains the coil assemble 9; a flexible metallic fixing sleeve 5 (corresponding to the rotator) that surrounds the holder 4 and generates heat due to induction current of the coil 2; and a pressure roller 6 that presses the holder 4 across the fixing sleeve 5.

The pressure roller 6 is driven to rotate in order to pass the recording paper 8 through the nip area to fuse and fix the toner on the recording paper 8 and simultaneously causes the fixing sleeve 5 together with the recording paper 8 to follow. The term "recording paper" is used to represent a concept comprising various recording media on which the toner image is fixed.

The fixing sleeve 5 is preferably made of a ferromagnetic material such as iron or nickel. It is because that it induces more magnetic flux to pass through to improve the heating efficiency of the fixing sleeve. The thickness of the metal layer of the fixing sleeve 5 is preferably about 20–60 $\mu$m.

It is because that the thinner the sleeve 5 is, the smaller the heat capacity becomes, thus reducing the power consumption for heating, but if it is too thin, it becomes too weak and easily breakable. It is also difficult to maintain a constant thickness of the fixing sleeve 5 if it is too thin. If it is too thick, on the other hand, it gets vulnerable to bending and loses durability against localized bending in the nip area.

A very thin releasing layer (not shown) made of fluorocarbon resin is formed on the outer periphery of the fixing sleeve 5.

The fixing sleeve 5 is not affixed to any part of the apparatus and is free to rotate around the holder 4. On the other hand, the holder 4 is affixed to the apparatus and its surface, at least the area that makes a contact with the fixing sleeve 5, is formed of a heat resistant resin. The fixing sleeve 5 moves driven by the recording paper 8, which, in return, is driven by the rotating pressure roller 6, the interaction of which will be described later in more detail.

The coil 2 of the coil assembly 9 is formed by winding copper wire around an insulating bobbin 3 placed around a core 1. The bobbin 3 is, for example, made of a ceramic material or engineering plastic. The coil 2 is preferably a single copper wire or Litz copper wire covered with a fused layer and an isolation layer. In addition, the core 1 is a ferrite core or a laminated core, for example.

The pressure roller 6 comprises a core 61 where a shaft 63 is formed and a surface layer 62 with releasing and heat-resistant characteristics formed around the core 61. The shaft 63 is supported rotatably by a sleeve bearing (not shown) provided on each end and is pressed in the direction of the fixing sleeve by a spring 50 affixed to the fixing unit frame 55 of the image forming apparatus main body. A drive gear (not shown) is affixed to one end of the shaft 63. The pressure roller 6 is driven to rotate by a drive power source (not shown) such as an electric motor connected to the drive gear.

Figure 2:
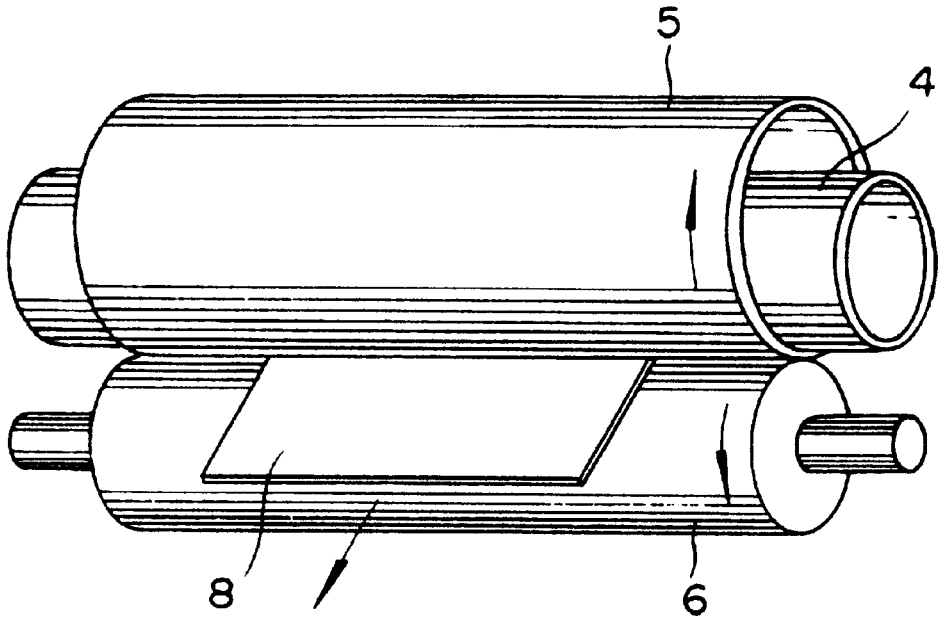
FIG. 2 is a perspective view of a recording paper passing through a nip area of the fixing apparatus.
Figure 18B:
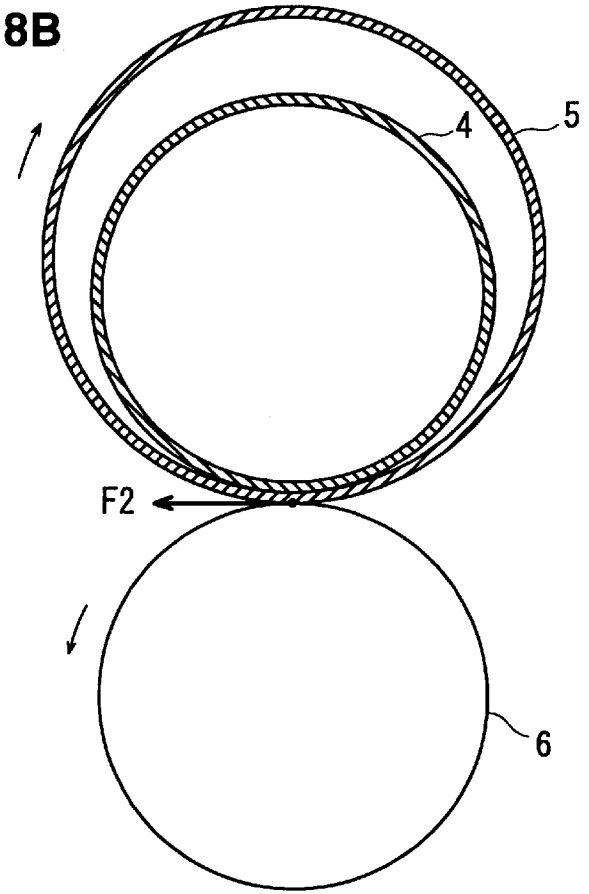
FIGS. 18A and 18B are cross sections of the fixing apparatus shown in FIG. 2.
Figure 18A:
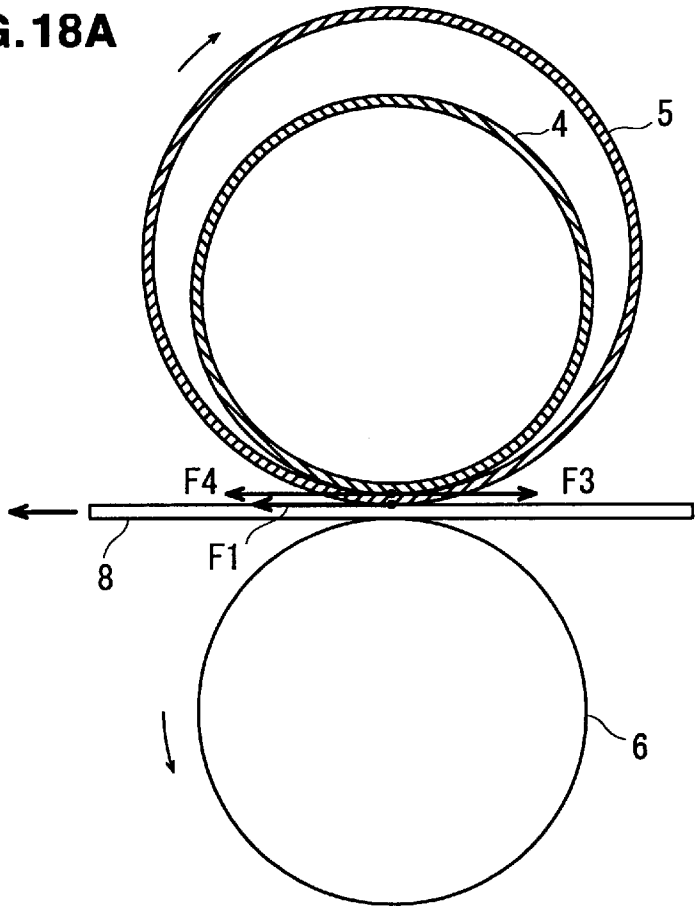

FIGS. 2, 18A and 18B show how the recording paper passes through the nip area of the fixing apparatus.

When the recording paper 8 is fed, the pressure roller 6 transmits the drive force F1 to the fixing sleeve 5 via the recording paper 8 in a passing region where recording paper passes through, the driving force F2 directly to the fixing sleeve 5 in a non-passage region where recording paper does not pass through, and causes a sliding area load or friction resistance force F3 at the contact area between the inner surface of the fixing sleeve 5 and the outer surface of the holder 4.

The fixing apparatus is configured to satisfy the following relation:

$$(F1+F2)/F3 \geqq a$$

The ratio "a" in the above formula is determined from an experiment described below.

The fixing sleeve 5 rotates in a stable manner without deteriorating the rotation, driven by the drive force transmitted from the pressure roller 6 when the sum of the drive force F1 and the drive force F2 is maintained greater than "a" times of the friction resistance force F3. Therefore, it is necessary to set the friction force F3 smaller and the drive forces F1 and F2 larger.

Experiment 1

An experiment was conducted in order to keep the friction resistance force F3, i.e., the sliding area load between the inner surface of the fixing sleeve 5 and the outer surface of the holder 4 as small as possible.

Figure 3:
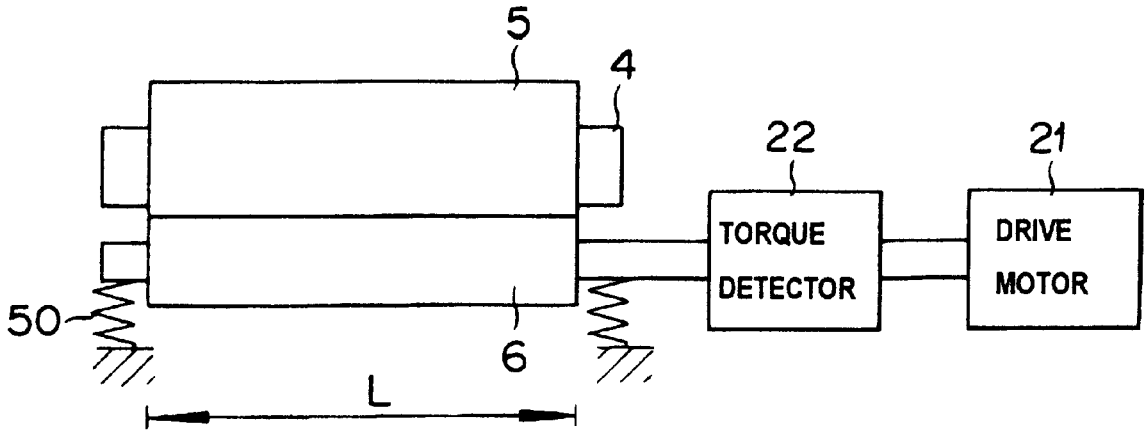
FIG. 3 is a schematic diagram of an experiment intended to measure a load generated in a sliding area between the inner surface of a fixing sleeve and the outer surface of a holder.

FIG. 3 is a schematic drawing of the experiment of measuring the sliding area load.

The friction resistance force F3 was obtained by connecting a torque detector 22 between the pressure roller 6 and a drive motor 21 and measuring the motor load required to rotate the fixing sleeve 5 directly.

The experiment conditions were as follows:

Temperature during the experiment:
150° C. (fixing sleeve surface)

Figure 4:
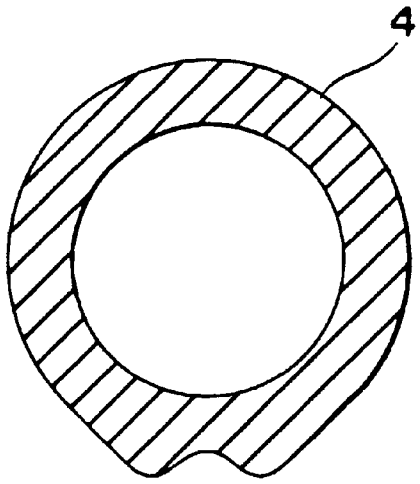
FIG. 4 is a cross section of the holder.

Cross section of the holder:
See FIG. 4 (nip side is on the bottom)

Pressuring force:
Target 7 kg (actual data 6.5 kg)

Measuring system speed:
150 [mm/sec]

The experiment was conducted under various conditions in order to determine the effects of materials and surface finishes of the fixing sleeve and the holder, as well as the use or lack of lubricants to the friction resistance force F3. The conditions 1–4 of Table 1 shown below were obtained as effective combinations. The size of the width direction or axial size of the fixing sleeve inner surface and the outer surface of the holder, i.e., the length L shown in FIG. 3 was 300 mm.

TABLE 1

| | Fixing sleeve | Holder | Lubricant | F3 [kg · cm] |
|---|---|---|---|---|
| Condition 1 | No inner coating | PPS (flat surface) | Fluorine dry lubricant | 2.1 |
| Condition 2 | PTFE baked | PEEK (undulated surface) | No lubricant | 1.9 |
| Condition 3 | Molybdenum coated | PEEK (undulated surface) | No lubricant | 2.0 |
| Condition 4 | Molybdenum coated | PPS (undulated surface) | No lubricant | 2.2 |

Note:
PTFE = polytetrafluoroethylene,
PPS = polyphenylenesulfide,
PEEK = polypether etherketone.
Undulated surfaces were formed by wire-cut EDM.

Experiment 2

The experiment was conducted to find the optimum drive force to be transmitted from the pressure roller 6 to the fixing sleeve 5. The optimum drive force here is meant to be the maximum torque that can be transmitted without causing a slip.

Figure 5:
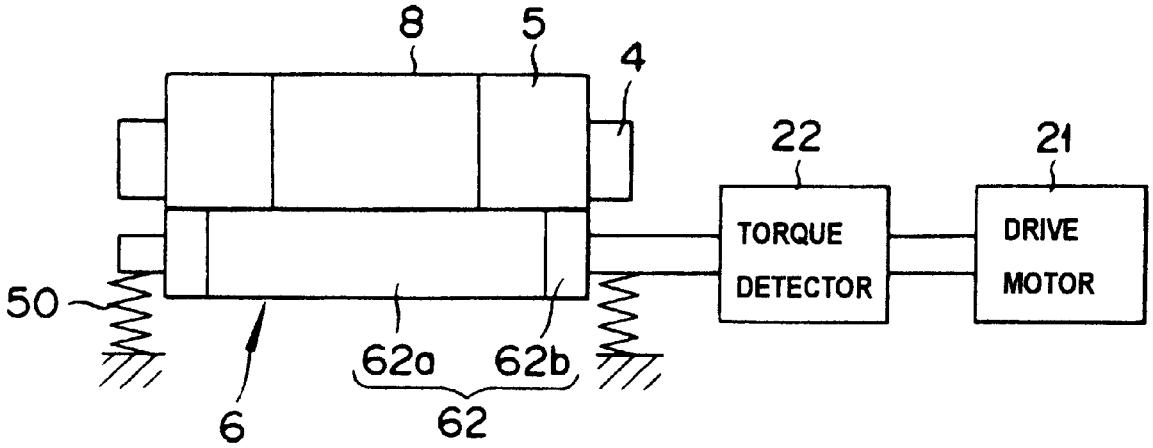
FIG. 5 is a schematic diagram of an experiment intended to measure a drive force transmitted from a pressure roller to the fixing sleeve at various points.

FIG. 5 is a schematic diagram of an experiment intended measure a drive force transmitted at various points.

A normal paper with a grammage of 157 [g/m$^2$] was used as the recording paper 8. The pressure roller 6 was covered by a surface layer 62 consisting of a tube 62*a* made of PFA (perfluoroalkoxyfluorocarbon resin) located in the middle and drive rings 62*b* made of rubber located on both ends. The axial length of the fixing sleeve 5 was 320 mm. Other experiment conditions were the same as in the experiment 1.

In the experiment 2, the torque required to rotate the pressure roller 6 was measured as follows by fixing the fixing sleeve 5 and the recording paper 8 on the holder to prevent them from rotating.

First, the torque required for the pressure roller 6 was measured while wrapping the recording paper 8 around the pressure roller 6 and fixing the fixing sleeve 5 on the holder to prevent it from rotating. As a result, it was learned that the friction resistance force or driving force F1 developed between the recording paper 8 and the fixing sleeve 5 was 2.4 kg. cm when the length L of sliding area between the inner surface of the fixing sleeve and the outer surface of the holder was 300 mm. Thus, the force f1, or the driving force per unit length of the width direction was calculated as 0.008 kg. cm/mm (=2.4/300).

Next, the force f3, or the friction resistance force per unit length of the width direction was calculated based on the condition 3 of the condition of Table 1 obtained when the length L of sliding area between the inner surface of the fixing sleeve and the outer surface of the holder was 300 mm. Since the friction resistance force F3 is 2.0 kg. cm and the length L of sliding area was 300 mm, the force f3, or the friction resistance force per unit length of the width direction was calculated as 0.0067 kg. cm/mm (=2.0/300).

Lastly, in the configuration shown in FIG. 5, an experiment was conducted for several widths for the recording paper 8 and the drive ring 62*b*. Based on the experiment, the drive force was calculated for each area considering the forces f1 and f3 calculated above. The result of the calculations is shown in Table 2 below. Table 2 also shows the forces f1 and f3.

TABLE 2

| Symbol | Place | Drive or Friction force [kg · cm/mm] |
|---|---|---|
| f1 | Recording paper and fixing sleeve | 0.008 |
| f2a | Fixing sleeve and PFA tube | 0.012 |
| f2b | Fixing sleeve and drive ring | 0.032 |
| f3 | Fixing sleeve inner surface and holder outer surface | 0.0067 |
| f1' | Recording paper and PFA tube | 0.01 |

Experiment 3

The driving force transmitted to the fixing sleeve was adjusted by changing the width of the drive ring 62*b* to find the maximum recording paper width that provides good performances (the maximum recording paper width that allows feeding of the paper without disturbing stable rotation of the fixing sleeve) and the minimum recording paper width that causes irregular performances (the minimum recording paper width that causes unstable rotation of the fixing sleeve, thus preventing stable feeding of the paper).

Figure 6:
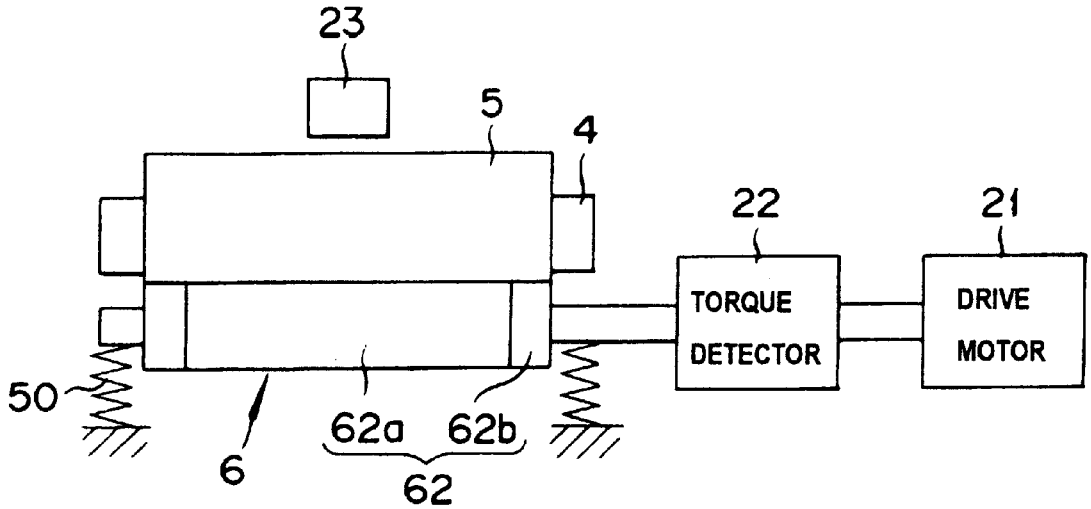
FIG. 6 is a schematic diagram of an experiment intended to measure a recording paper size of a maximum width that can pass through in a stable manner for drive rings of various sizes.

FIG. 6 is the schematic drawing of the experiment. The rotation of the sleeve was checked by a speed sensor 23 to judge whether it is acceptable or not. Various types of conventional tachometers are usable as the speed sensor 23.

The test result is shown in Table 3. Table 3 shows the maximum recording paper width that provides good performances and the minimum recording paper width that causes irregular performances corresponding to the width of the drive ring are shown.

TABLE 3

| Width of drive ring [mm] | Maximum recording paper width that provides good performances [mm] | Minimum recording paper width that causes irregular performances [mm] |
|---|---|---|
| Condition 1: 60 | 260 | 280 |
| Condition 2: 40 | 260 | 280 |
| Condition 3: 20 | 180 | 200 |
| Condition 4: 0 | 100 | 120 |

Note:
The total length of the pressure roller was 320 for the conditions 1–3, but it was 300 mm for the condition 4.

The paper feeding itself was executed even when the rotation of the fixing sleeve 5 was unstable during the paper feed as mentioned above. It was suspected that the paper transfer force is provided by the pressure roller 6, and the rotational instability of the fixing sleeve 5 is caused by the driving force transmitted by the pressure roller 6 to the fixing sleeve 5 is intercepted by the paper feeding.

Therefore, using the driving and friction resistance forces of various parts per unit width direction length obtained in the Experiment 2, the driving forces transmitted to the fixing sleeve 5 under the conditions 1–4 were calculated. What is meant by the "driving force" is the sum of a driving force F2*b* transmitted from the driving rings 62*b* to the fixing sleeve 5, a driving force F2*a* transmitted from the FPA tube 62*a* to the fixing sleeve 5, and a driving force F1 transmitted from the pressure roller 6 to the fixing sleeve 5 via the recording paper 8.

Next the friction resistance force F3 generated between the inner surface of the fixing sleeve 5 and the outer surface of the holder 4, i.e., the sliding area load is calculated. The ratio k of the total driving force against the sliding area load (=(F1+F2*a*+F2*b*)/F3) was obtained.

Condition 1: Driving ring width: 60 mm
(a) Case of good rotation
F1+F2*b*=260×0.008+60×0.032=4
F3=320×0.0067=2.14
k=4/2.14=1.87
(b) Case of unstable rotation
F1+F2*b*=280×0.008+40×0.032=3.52
k=3.52/2.14=1.64

Condition 2: Driving ring width: 40 mm
(a) Case of good rotation
F1+F2*a*+F2*b*=260×0.008+20×0.012+40×0.032=3.6
k=3.6/2.14=1.68
(b) Case of unstable rotation
F1+F2*b*=280×0.008+40×0.032=3.52
k=3.52/2.14=1.64

Condition 3: Driving ring width: 20 mm
(a) Case of good rotation
F1+F2*a*+F2*b*=180×0.008+120×0.012+20×0.032=3.52
k=3.52/2.14=1.64
(b) Case of unstable rotation
F1+F2*a*+F2*b*=200×0.008+100×0.012+20×0.032=3.44
k=3.44/2.14=1.60

Condition 4: Driving ring width: 0 mm
(a) Case of good rotation
F1+F2*a*=100×0.008+200×0.012=3.2
F3=300×0.0067=2.0
k=3.2/2.0=1.60
(b) Case of unstable rotation
F1+F2*a*=120×0.008+180×0.012=3.12
k=3.12/2.0=1.56

Table 4 below is the summary of the above calculations focusing on the ratio k.

TABLE 4

| | Ratio k | |
|---|---|---|
| Width of drive ring [mm] | Fixing sleeve rotation Good | Fixing sleeve rotation NG |
| Condition 1: 60 | 1.87 | 1.64 |
| Condition 2: 40 | 1.68 | 1.64 |
| Condition 3: 20 | 1.64 | 1.60 |
| Condition 4: 0 | 1.60 | 1.56 |

As we can see from Table 4, the boundary between good and no good categories of the rotation of the fixing sleeve 5 is where the total drive force is 1.60–1.70 of the sliding area load.

Consequently, the fixing apparatus is configured to satisfy the following relation:

$$(F1+F2)/F3 \geqq a \quad (a=1.70)$$

This is accomplished specifically by making the width of the drive ring 62*b* to be the necessary minimum.

As a conclusion, in the first embodiment, since it is so configured that a drive force exceeding 1.7 times of the friction resistance force generated between the inner surface of the fixing sleeve 5 and the outer surface of the holder 4 to be transmitted, the rotation of the fixing sleeve 5 is not affected and the fixing sleeve 5 rotates smoothly in a stable manner. This contributes to the improvement of the fixing quality.

Although the holder 4 is arranged affixed in the specific examples of the first embodiment discussed above, the present invention is not limited to these examples. For example, it is possible to support the holder 4 rotatably, and allow the fixing sleeve 5 to drive the holder 4. Such a fixing apparatus can accomplish the similar effect by configuring to satisfy the following relation:

$$(F1+F2)/F3 \geqq 1.7$$

and $$F3<F4$$

where symbols F3 and F4 represent the rotation resistance forces of the holder and the friction resistance between the friction resistance force between the inner surface of the sleeve and the outer surface of the holder respectively.

It is because the rotation resistance force is the predominant contact area load between the inner surface of the fixing sleeve and the outer surface of the holder.

Embodiment 2

Figure 7:
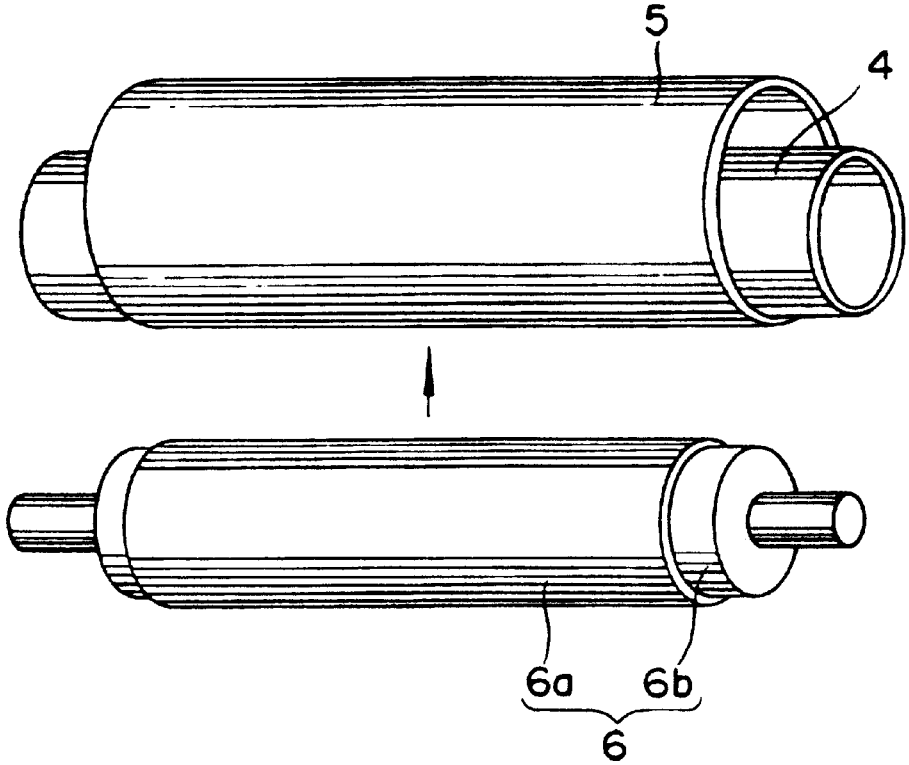
FIG. 7 is a perspective view in a disassembled state of a fixing apparatus of a second embodiment according to the invention.

In a fixing apparatus shown in FIG. 7, the pressure roller 6 consists of a middle section 6*a* and end sections 6*b* formed on both sides thereof. The outer diameter of the middle section 6*a* is larger than the diameter of the end sections 6*b*, and the hardness of the end sections 6*b* is higher than that of the middle section 6*a*.

In other words, if the recording paper 8 is transferred by the middle section, all or a part of the non-passage region of the pressure roller 6 has a diameter smaller and harder surface compared to the part of the pressure roller 6 located in the passing region. The second embodiment is similar to the first embodiment as to other points of characteristics. Parts common to those of the first embodiment are identified by the same symbols so that their descriptions can be omitted.

Figure 8:
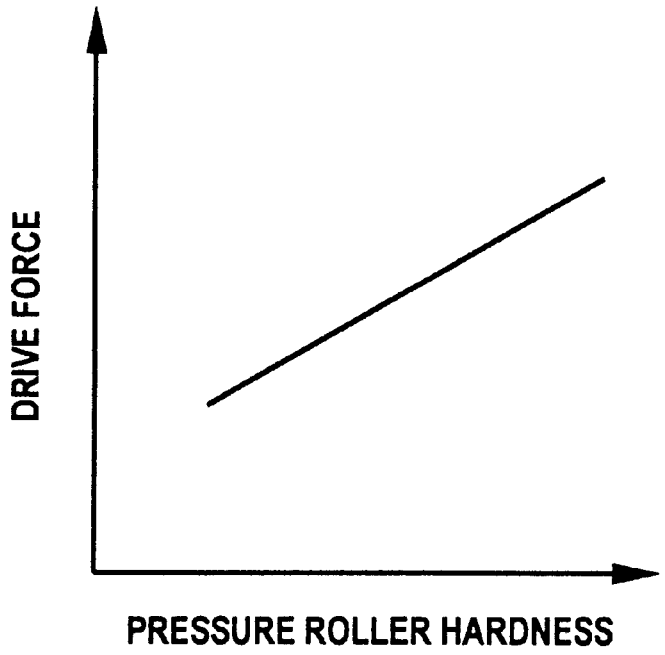
FIG. 8 is a diagram showing the relation between the hardness of the pressure roller and the drive force transmitted to the fixing sleeve from the pressure roller.

FIG. 8 is a relation between the hardness of the pressure roller and the drive force transmitted from the pressure roller to the fixing sleeve. As can be seen from the figure, the drive force transmitted to the fixing sleeve 5 increases with the increase of the hardness of the pressure roller 6. Therefore, the drive force for rotating the fixing sleeve 5 can be increased by increasing the hardness of the end sections 6*b* as a whole.

Figure 9:
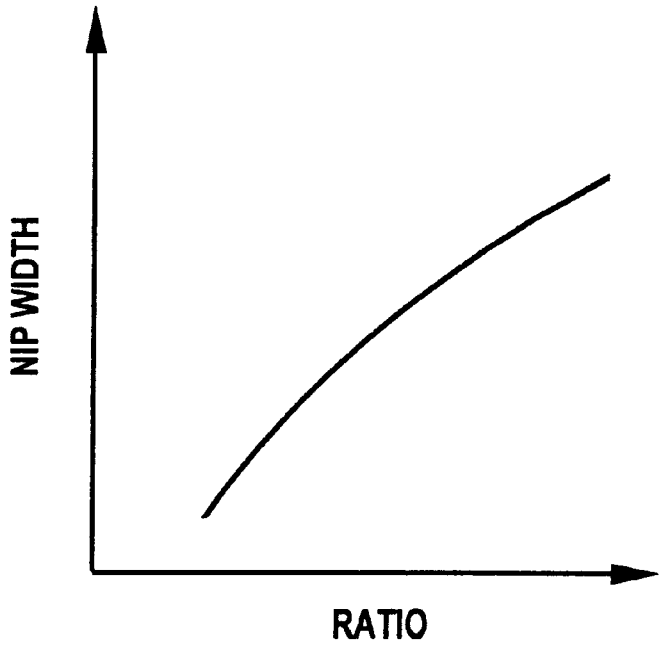
FIG. 9 is a diagram showing the relation between the ratio of diameters at the center and at the end of the pressure roller against nip width.

In addition, FIG. 9 shows the relation between the outer diameter of the middle section and that of the end sections of the pressure roller and the nip width. As can be seen from the figure, the larger the ratio between the outer diameter of the middle section 6*a* and that of the end sections 6*b*, the larger the nip width between the pressure roller 6 and the fixing sleeve. This is because the middle section 6*a*, which is relatively softer than the end sections 6*b*, generates a larger deformation.

With the above configuration, the drive force transmitted from the pressure roller to the fixing sleeve increases so that it provides a smooth stable rotation to the fixing sleeve void of any irregular rotations, and increase the nip width, thus enabling us to achieve good fixing at lower fixing temperatures.

Embodiment 3

Figure 10:
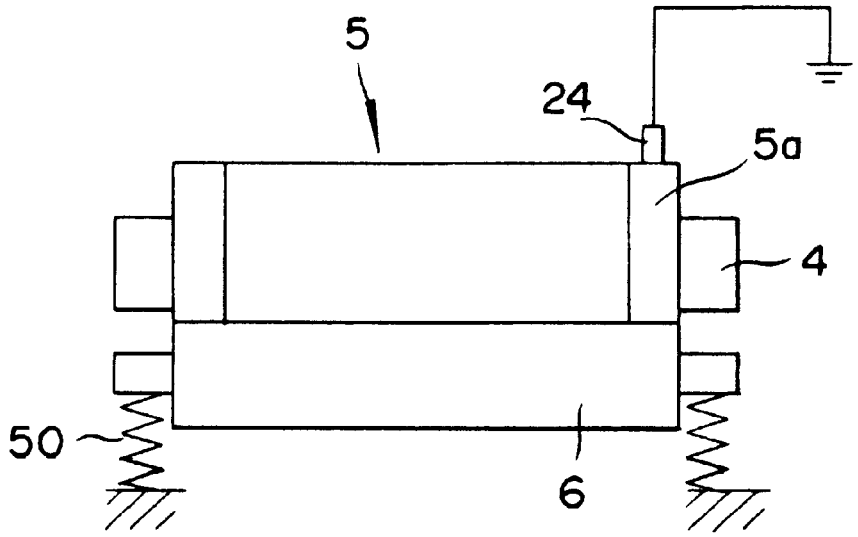
FIG. 10 is a side view of a fixing apparatus of a third embodiment according to the invention.

In a fixing apparatus shown in FIG. 10, the base of the fixing sleeve 5 is made of metal, and all or a portion of the surfaces 5*a* outside of the maximum paper width area is not covered with a releasing agent layer and is exposing the base metal. The exposed metal area 5*a* is grounded via a conductive brush 24. This third embodiment is similar to the first embodiment as to other points of characteristics. Parts common to those of the first embodiment are identified by the same symbols so that their descriptions can be omitted.

In the above constitution, since the fixing sleeve 5 is grounded, static electricity does not accumulate, thus preventing the possibility of any disturbances against stable rotation of the fixing sleeve 5 due to static electricity.

Embodiment 4

Figure 11:
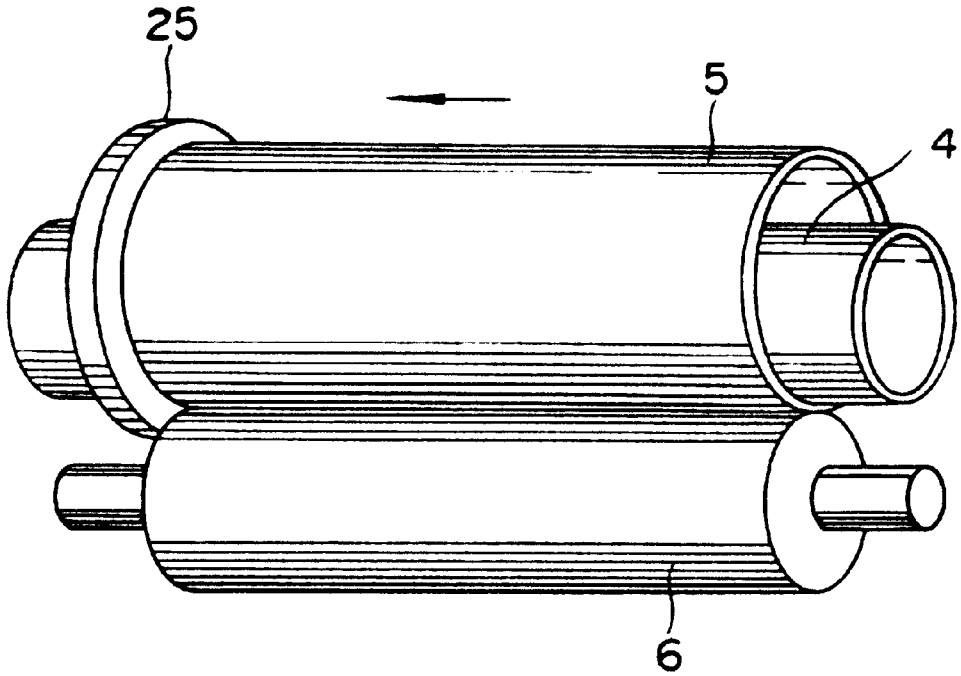
FIG. 11 is a perspective view of a fixing apparatus of a fourth embodiment according to the invention.
Figure 12:
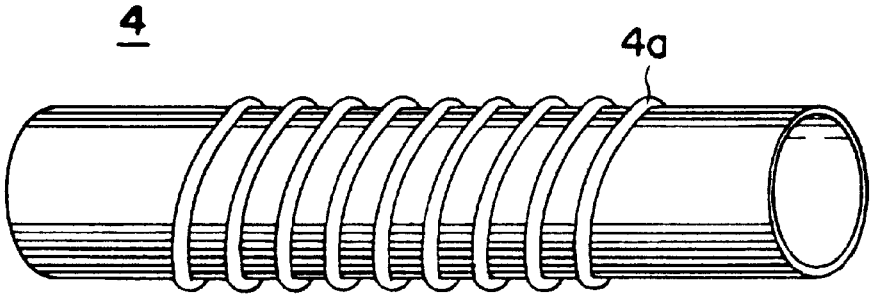
FIG. 12 is a perspective view of a holder of the fixing apparatus.

In a fixing apparatus shown in FIG. 11, a stopper 25 is provided on one end of the fixing sleeve 5 to curb snaking motion of the fixing sleeve 5. Furthermore, a quasi spiral protrusion 4*a* is formed on the outside surface of the holder 4 of the fixing apparatus as shown in FIG. 12. The stopper 25 is provided on the side to which the fixing sleeve tends to drift due to the shape of the protrusion 4*a* and the rotation direction of the fixing sleeve 5. This fourth embodiment is similar to the first embodiment except the point mentioned above.

With the above configuration, the contact area between the outer surface of the holder 4 and the inner surface of the fixing sleeve 5 reduces, thus reducing the friction resistance force drastically, so that irregular rotation of the fixing sleeve can be easily prevented.

Also, if the fixing sleeve 5 drifts widthwise in the direction of the arrow shown in FIG. 11 as a result of the action of the protrusion 4*a*, the stopper 25 stops said motion, thus assuring stable rotation of the fixing sleeve 5.

Embodiment 5

Figure 13:
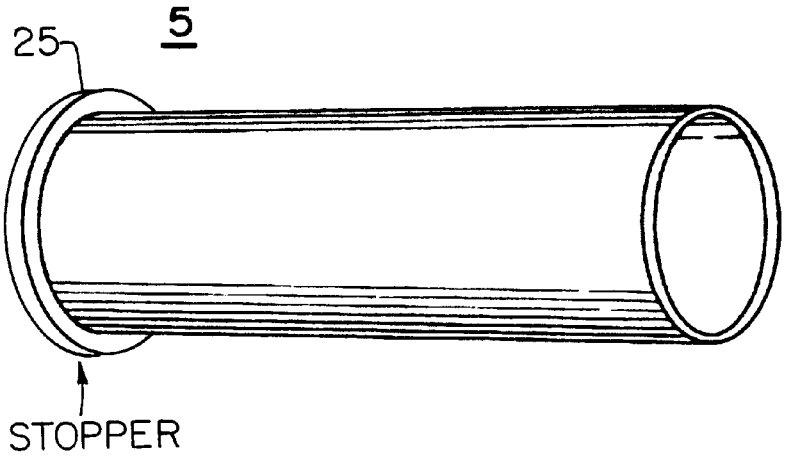
FIG. 13 is a perspective view of a fixing sleeve of a fixing apparatus of a fifth embodiment according to the invention.

The fixing sleeve 5 shown in FIG. 13 is generally conical and a stopper 25 is provided to stop the widthwise drift of the fixing sleeve. This fifth embodiment is similar to the first embodiment except the point mentioned above.

With the above simple configuration, it not only prevents the irregular rotation of the fixing sleeve, but also intentionally stops the widthwise drift of the fixing sleeve 5 due to unbalanced contact pressures, offset of the pressure roller and the holder shaft, etc., by means of the stopper provided on the side of the shorter circumference of the sleeve, thus achieving more stable rotation of fixing sleeve 5.

Embodiment 6

Figure 14:
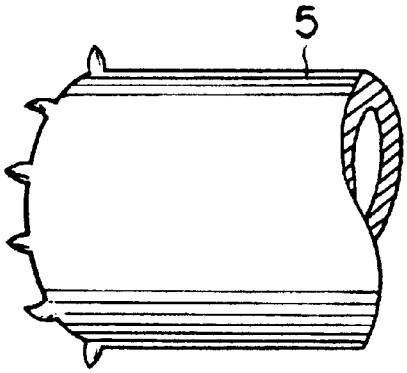
FIG. 14 is a partial perspective view of a fixing apparatus of a sixth embodiment according to the invention.

The fixing sleeve 5 shown in FIG. 14 has at least one of the ends partially bent perpendicularly. This sixth embodiment is similar to the first embodiment except the point mentioned above.

With the above simple configuration, in addition to preventing the irregular rotation of the fixing sleeve, its bent edge is guided by the edge of the pressure roller, thus controlling the widthwise drift of the fixing sleeve 5 and achieving more stable rotation of the fixing sleeve 5.

Embodiment 7

Figure 15:
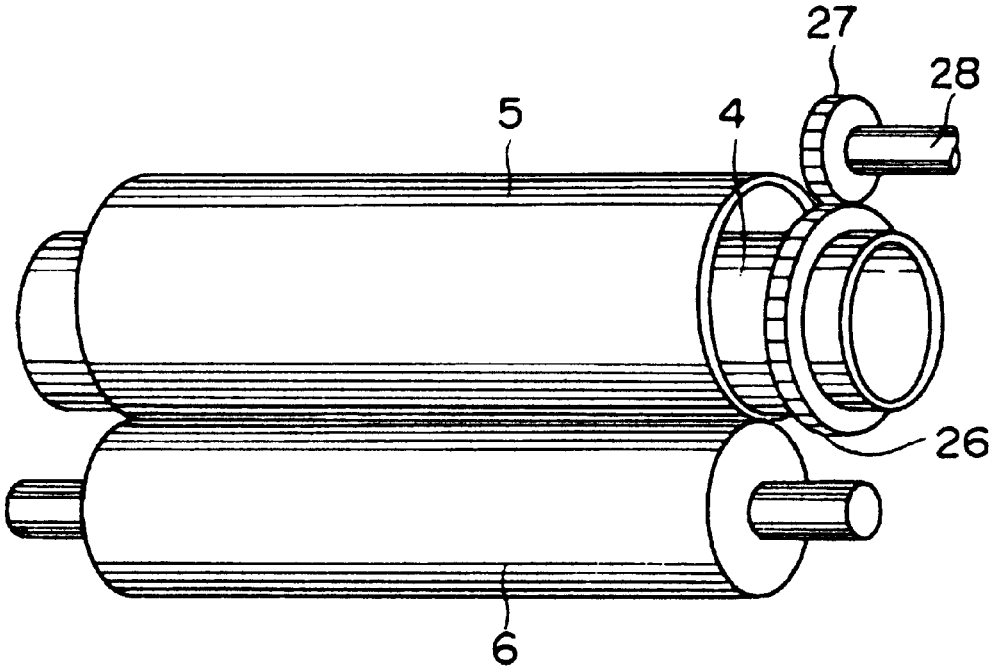
FIG. 15 is a perspective view of a fixing apparatus of a seventh embodiment according to the invention.
Figure 19B:
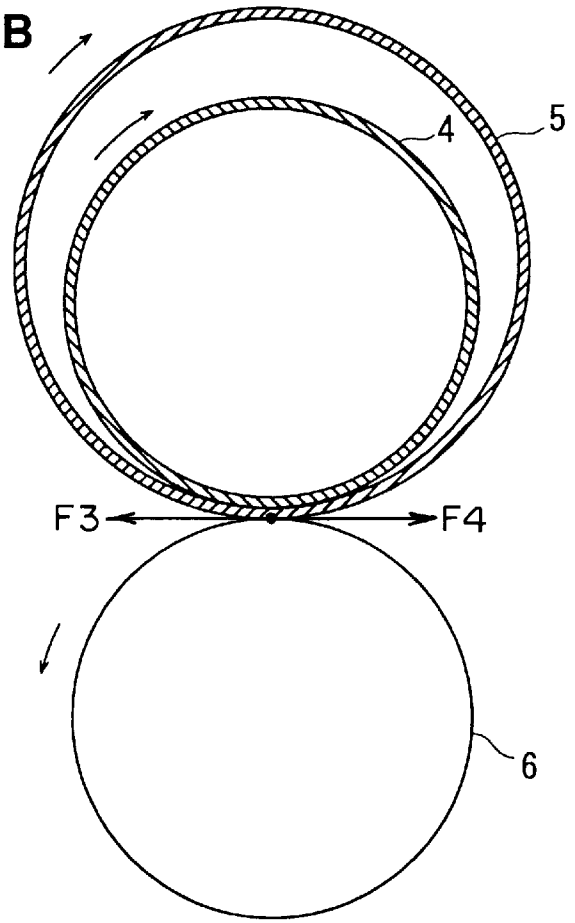
FIGS. 19A and 19B are cross sections of the fixing apparatus shown in FIG. 15.
Figure 19A:
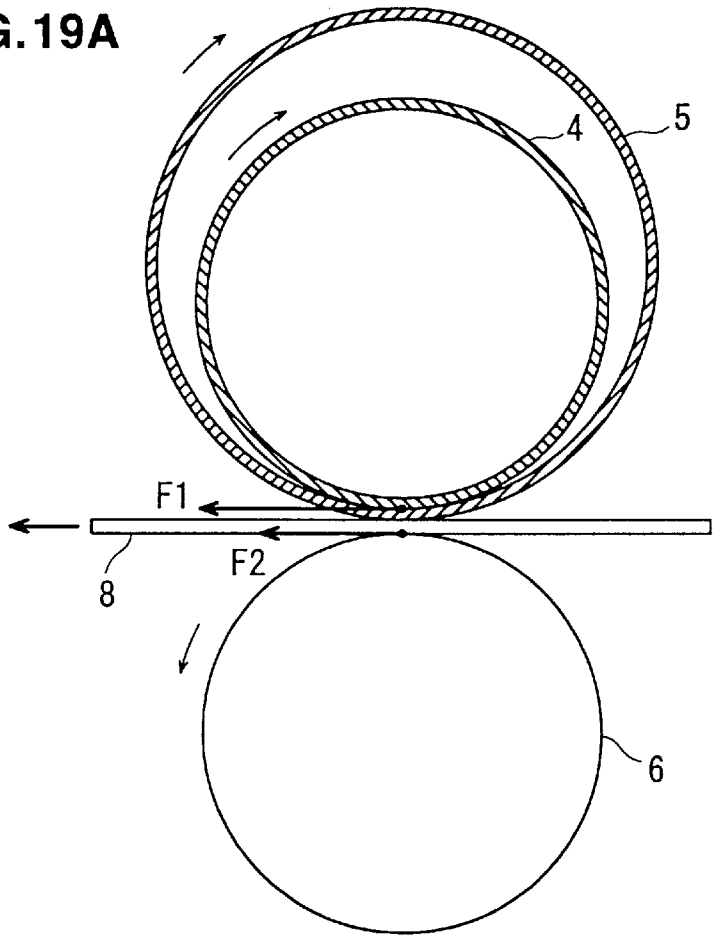

The fixing apparatus shown in FIGS. 15, 19A and 19B comprises: a holder 4 that drives the fixing sleeve 5 by means of supporting the fixing sleeve 5 from the inside; and a pressure roller 6 that is contacting the holder 4 under pressure via the fixing sleeve 5 so as to rotate following the rotation of the fixing sleeve 5. This seventh embodiment is different from the first through sixth embodiments in the above point. More specifically, the holder 4 is driven by an electric motor (not shown) via a gear 26 affixed to one end of the holder 4, which engages with a gear 27 affixed to the shaft 28 connected to the motor shaft.

The fixing apparatus is configured to fulfil the following relation:

$$F1/F4 \geqq 1.7$$

and $$F2+F3 \geqq F4$$

where symbols F1, F2, F3 and F4 represent: a drive force transmitted from the holder 4 to the inner surface of the fixing sleeve 5; a drive force transmitted from the holder 4 to the pressure roller 6 via the fixing sleeve 5 and the recording paper in the passing region where the recording paper passes through; a drive force transmitted from the holder 4 to the pressure roller 6 via the fixing sleeve 5 in the non-passage region where the recording paper does not pass through; and a rotation resistance force generated in the pressure roller 6 when it is driven by the fixing sleeve 5 respectively, all of which relating to the time when the recording paper passes through the system.

The above configuration provides essentially the same action as the first embodiment and provides a smooth stable rotation to the fixing sleeve void of any irregular rotations.

Embodiment 8

Figure 16:
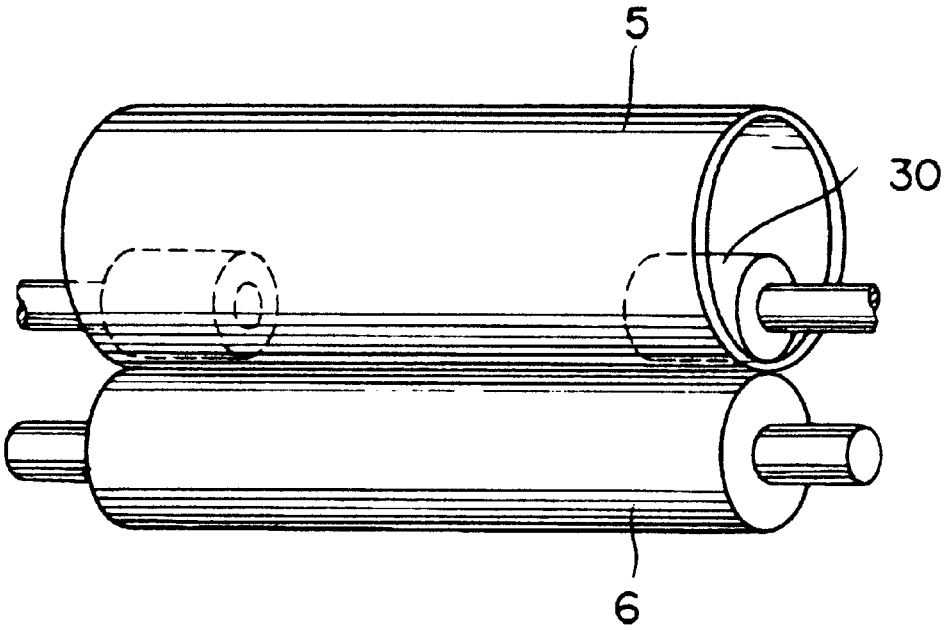
FIG. 16 is a perspective view of a fixing apparatus of a eighth embodiment according to the invention.
Figure 20B:
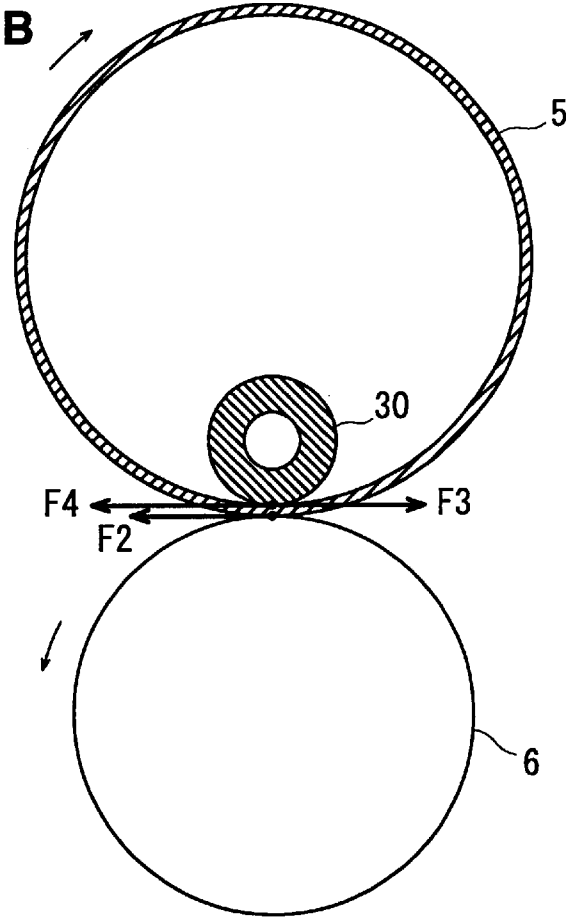
FIGS. 20A and 20B are cross sections of the fixing apparatus shown in FIG. 16.
Figure 20A:
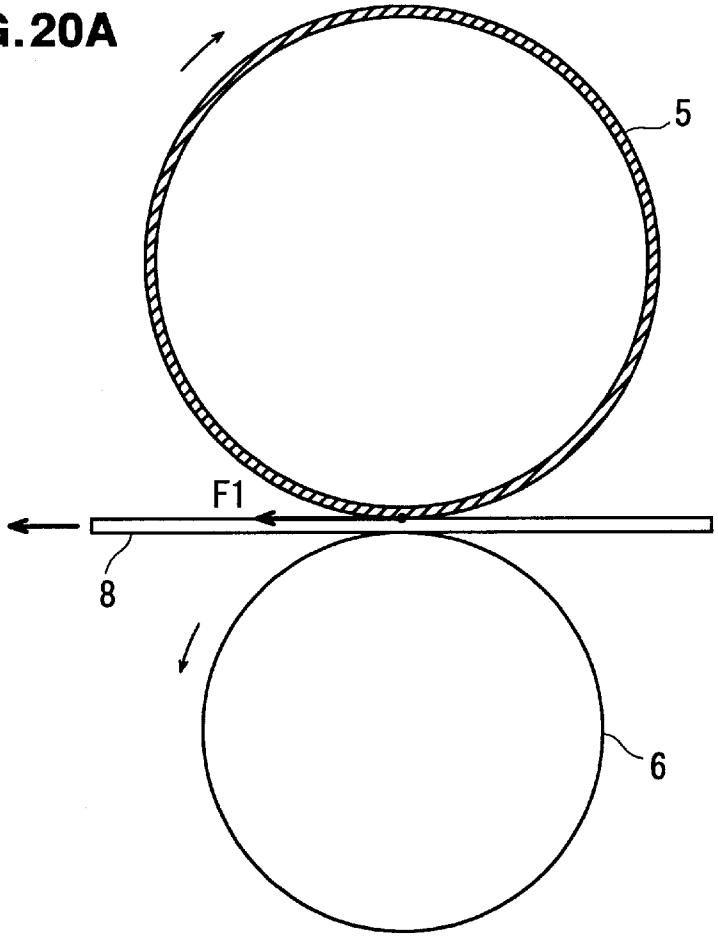

The fixing apparatus shown in FIGS. 16, 20A and 20B comprises: supports 30 that are provided at each end of the fixing sleeve 5 rotating freely, and sustain the fixing sleeve 5 from the inside; and a pressure roller 6 contacting the supports 30 under pressure via the fixing sleeve 5 thus driving the fixing sleeve 5 by nipping it between itself and the supports 30. This eighth embodiment is different from the first embodiment in the above point.

The fixing apparatus is configured to fulfil the following relation:

$$(F1+F2)/F3 \geqq 1.7$$

and $$F3<F4$$

where symbols F1, F2, F3 and F4 represent: a drive force transmitted from the pressure roller 6 to the fixing sleeve 5 via the recording paper in the passing region where the recording paper passes through; a drive force transmitted from the pressure roller 6 directly to the fixing sleeve 5 in the non-passage region where the recording paper does not pass through; a rotation resistance force of the supports 30; and a rotation resistance force generated between the inner surface of the fixing sleeve 5 and the outer surface of the supports 30 respectively, all of which relating to the time when the recording paper passes through the system.

In the above configuration, the rotation resistance force of the supports 30 is the predominant contact area load between the inner surface of the fixing sleeve 5 and the outer surface of the supports 30. Therefore, this eighth embodiment is capable of providing a smooth and stable rotation to the fixing sleeve void of any irregular rotations similar to the first embodiment.

It is obvious that this invention is not limited to the particular embodiments shown and described above but may be variously changed and modified by any person of ordinary skill in the art without departing from the technical concept of this invention.

Figure 17:
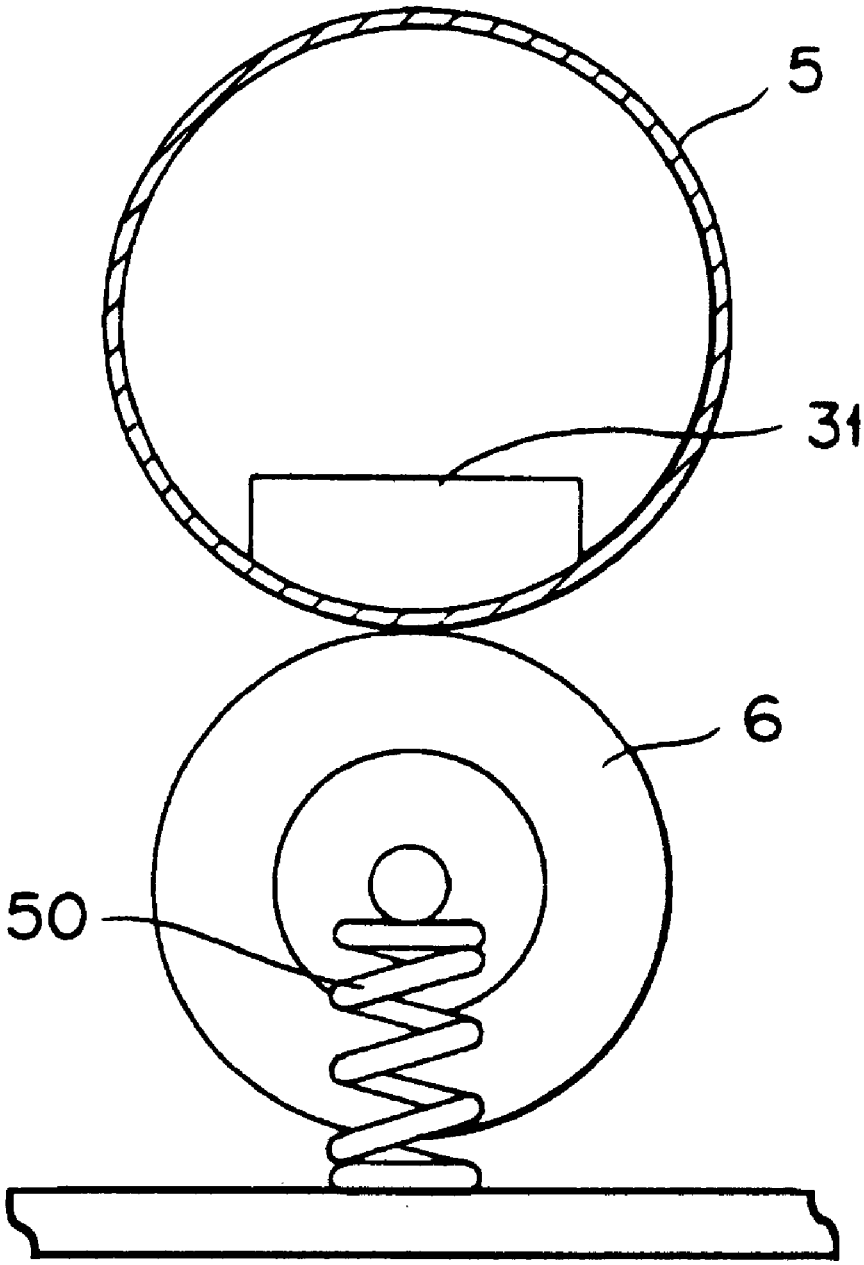
FIG. 17 is a side view of a fixing apparatus of another application where a fixing sleeve is heated by a ceramic heater.

Although the induction heating method is being used in the first through eighth embodiments for the heating device of the fixing sleeve, the invention should not be construed to be limited to it. As can be easily conceived by a person experienced in the art, the present invention can be applied to a fixing apparatus, for example, where the fixing sleeve is heated by a ceramic heater 31 as shown in FIG. 17. The bottom of the ceramic heater 31 serves as the holder 4 of the first embodiment in this case.

What is claimed is:

1. A fixing apparatus comprising: a rotator having a releasing agent layer on a surface thereof, a holder that supports said rotator from an inside thereof, a heating device to heat said rotator, and a drive roller with which said rotator is in contact under pressure to be driven thereby, wherein the rotator is driven by the roller according to the following relation:

$$(F1+F2)/F3 \geqq 1.7$$

where symbols F1, F2 and F3 represent respectively during feeding of a recording paper: a drive force transmitted from said drive roller to said rotator via the recording paper in a passing region where the recording paper passes through; a drive force transmitted directly from said drive roller to said rotator in a non-passage region where the recording paper does not pass through; and a load that occurs in a contact area between an inner surface of said rotator and an outer surface of said holder.

2. A fixing apparatus according to claim 1, in which said holder is rotatably supported and driven by said rotator and said contact area load F3 consists of a rotating resistance of said holder, satisfying the following relation:

$$(F1+F2)/F3 \geqq 1.7$$

and $$F3<F4$$

where symbol F4 represents a friction resistance force generated between the inner surface of said rotator and the outer surface of said holder when said holder is driven by said rotator.

3. A fixing apparatus according to claim 1, in which all or a part of said drive roller located in the non-passage region has a smaller diameter and is harder than a part of said drive roller located in the passing region.

4. A fixing apparatus according to claim 1, in which said rotator has a base made of metal, all or a part of its surface outside a widest paper width area is not covered with any releasing agent layer and the base metal is exposed, said exposed metal area being grounded.

5. A fixing apparatus according to claim 1, in which the outer surface of said holder has a quasi spiral shaped protrusion.

6. A fixing apparatus according to claim 5, further comprising a stopper that prevents said rotator from drifting in a width direction, said stopper being placed only on a side of a drifting direction, which is determined by said protrusion and a rotating direction of said rotator.

7. A fixing apparatus according to claim 1, in which at least one end of said rotator is partially bent in a perpendicular direction.

8. A fixing apparatus according to claim 1, in which said rotator is substantially in a conical shape and a stopper to prevent said rotator from drifting in a width direction is placed on a shorter circumference's side of said rotator.

9. A fixing apparatus according to claim 1, in which said heating device heats said rotator by means of an induction current generated by a coil provided on said holder.

10. A fixing apparatus according to claim 1, in which said heating device heats said rotator by means of a heater provided inside of said rotator.

11. A fixing apparatus comprising: a rotator having a releasing agent layer on a surface thereof, a holder that supports said rotator from an inside thereof and rotates to cause said rotator to rotate, a heating device to heat said rotator, and a driven roller which is in contact with said rotator under pressure to be driven thereby, wherein the rotator is driven by the roller according to the following relation:

$$F1/F4 \geqq 1.7$$

and $$F2+F3 \geqq F4$$

where symbols F1, F2, F3 and F4 represent respectively during feeding a recording paper: a drive force transmitted from said holder to an internal surface of said rotator; a drive force transmitted from the surface of said rotator to said driven roller via the recording paper in a passing region where the recording paper passes through; a drive force transmitted from the surface of said rotator directly to said driven roller in a non-passage region where the recording paper does not pass through; and a rotation resistance force generated when said driven roller is driven by said rotator.

12. A fixing apparatus according to claim 11, in which said heating device heats said rotator by means of an induction current generated by a coil provided on said holder.

13. A fixing apparatus according to claim 11, in which said heating device heats said rotator by means of a heater provided inside of said rotator.

14. A fixing apparatus comprising a rotator having a releasing agent layer on a surface thereof, supports that are maintained rotatably inside said rotator and sustain both ends of said rotator, a heating device to heat said rotator, and a drive roller that drives said rotator by nipping it between itself and said supports, the apparatus satisfying the following relation:

$$(F1+F2)/F3 \geqq 1.7$$

and $$F3<F4$$

where symbols F1, F2, F3 and F4 represent respectively during feeding a recording paper: a drive force transmitted from said drive roller to said rotator via the recording paper in a passing region where the recording paper passes through; a drive force transmitted directly from said drive roller to said rotator in a non-passage region where the recording paper does not pass through; a rotation resistance force of said supports; and a friction resistance force generated between an inner surface of said rotator and an outer surface of said supports.

15. A fixing apparatus according to claim 14, in which said heating device heats said rotator by means of an induction current generated by a coil provided on said holder.

16. A fixing apparatus according to claim 14, in which said heating device heats said rotator by means of a heater provided inside of said rotator.

* * * * *